US009496624B2

(12) United States Patent
Juan

(10) Patent No.: US 9,496,624 B2
(45) Date of Patent: Nov. 15, 2016

(54) ANTENNA DEVICE AND ANTENNA APPARATUS

(71) Applicant: AUDEN TECHNO CORP., Taoyuan County (TW)

(72) Inventor: Peng-Hao Juan, Taipei (TW)

(73) Assignee: AUDEN TECHNO CORP., Taoyuan County (TW)

( * ) Notice: Subject to any disclaimer, the term of this patent is extended or adjusted under 35 U.S.C. 154(b) by 84 days.

(21) Appl. No.: 14/666,381

(22) Filed: Mar. 24, 2015

(65) Prior Publication Data

US 2016/0285175 A1 Sep. 29, 2016

(51) Int. Cl.

| | |
|---|---|
| ***H01Q 21/00*** | (2006.01) |
| ***H01Q 21/30*** | (2006.01) |
| ***H01Q 21/26*** | (2006.01) |
| ***H01Q 1/32*** | (2006.01) |

(52) U.S. Cl.
CPC ..... *H01Q 21/30* (2013.01); *H01Q 1/3275* (2013.01); *H01Q 21/26* (2013.01)

(58) Field of Classification Search
CPC .... H01Q 21/28; H01Q 21/24; H01Q 5/0006; H01Q 5/0072; H01Q 21/29; H01Q 21/00
USPC ..... 343/727, 711–714
See application file for complete search history.

(56) References Cited

U.S. PATENT DOCUMENTS

| | | | | |
|---|---|---|---|---|
| 7,236,136 | B2 * | 6/2007 | Noro | H01Q 1/3275 343/713 |
| 7,239,281 | B2 * | 7/2007 | Lu | H01Q 1/3275 343/713 |
| 7,304,614 | B2 * | 12/2007 | Silva | H01Q 1/3275 343/711 |
| 8,022,861 | B2 * | 9/2011 | Margomenos | G01S 7/032 342/175 |
| 8,537,062 | B1 * | 9/2013 | Duzdar | H01Q 1/3275 343/713 |
| 8,686,907 | B2 * | 4/2014 | Jan | H01Q 1/521 343/713 |
| 2008/0012776 | A1 * | 1/2008 | Blickle | H01Q 1/1214 343/713 |
| 2010/0277379 | A1 * | 11/2010 | Lindackers | H01Q 1/1207 343/713 |

* cited by examiner

*Primary Examiner* — Huedung Mancuso
(74) *Attorney, Agent, or Firm* — Li & Cai Intellectual Property (USA) Office

(57) ABSTRACT

An antenna device includes a retaining seat, a first polarized antenna module, and a second polarized antenna module, both disposed on the retaining seat. The first polarized antenna module has a dual-band monopole antenna. The second polarized antenna module has a carrying frame disposed on the retaining seat, two dual-band dipole antennas in a coplanar arrangement formed on the carrying frame, and a splitter installed on the carrying frame. Each dual-band dipole antenna defines a longitudinal axis and has a feeding and a grounding segment arranged in the longitudinal axis. The longitudinal axes of the dual-band dipole antennas are perpendicular to each other. The polarized direction of the dual-band dipole antennas is perpendicular to the polarized direction of the dual-band monopole antenna. The splitter is electrically connected to the feeding segments for separating a current respectively into the feeding segments by a phase difference of 90 degrees.

10 Claims, 10 Drawing Sheets

ANTENNA DEVICE AND ANTENNA APPARATUS

BACKGROUND OF THE INVENTION

1. Field of the Invention

The instant invention relates to an antenna device in particular, to an antenna device and an antenna apparatus for a multi-input multi-output (MIMO) system.

2. Description of Related Art

High-speed train service including an internet communication is a future trend, and the conventional means for providing internet communication service when moving fast is achieved by the structural design of the antenna. However, the conventional structure of antennas is only provided for a single-input single-output (SISO) system having poor data transferring rates. To achieve improvement to the above-mentioned deficiencies, the inventors strive via industrial experience and academic research to present the instant disclosure.

SUMMARY OF THE INVENTION

The instant disclosure provides an antenna device and an antenna apparatus for MIMO system.

The instant disclosure provides an antenna apparatus, comprising: a transportation device having an elongated shape and defining a longitudinal direction an antenna device, comprising: a retaining seat mounted on the transportation device; a first polarized antenna module disposed on the retaining seat, wherein the first polarized antenna module has a dual-band monopole antenna arranged in a first plane approximately perpendicular to the longitudinal direction; and a second polarized antenna module, comprising: a carrying frame disposed on the retaining seat; two dual-band dipole antennas formed on the carrying frame and arranged in a second plane, wherein each dual-band dipole antenna defines a longitudinal axis, each dual-band dipole antenna has a feeding segment and a grounding segment arranged apart from the feeding segment, and the feeding segment and the grounding segment of each dual-band dipole antenna are arranged along the corresponding longitudinal axis, wherein the longitudinal axes of the dual-band dipole antennas are substantially perpendicular to each other, the second plane is approximately perpendicular to the first plane, a polarized direction of the dual-band dipole antennas is approximately perpendicular to a polarized direction of the dual-band monopole antenna; and a splitter mounted on the carrying frame and electrically connected to the feeding segments, wherein the splitter is configured for separating a current respectively into the feeding segments by a phase difference of 90 degrees.

The instant disclosure also provides an antenna device, comprising: a retaining seat; a first polarized antenna module disposed on the retaining seat, wherein the first polarized antenna module has a dual-band monopole antenna arranged in a first plane; and a second polarized antenna module, comprising: a carrying frame disposed on the retaining seat; two dual-band dipole antennas formed on the carrying frame in a second plane, wherein each dual-band dipole antenna defines a longitudinal axis, each dual-band dipole antenna has a feeding segment and a grounding segment arranged apart from the feeding segment, and the feeding segment and the grounding segment of each dual-band dipole antenna are arranged along the corresponding longitudinal axis, wherein the longitudinal axes of the dual-band dipole antennas are substantially perpendicular to each other, the second plane is approximately perpendicular to the first plane, a polarized direction of the dual-band dipole antennas is approximately perpendicular to a polarized direction of the dual-band monopole antenna; and a splitter mounted on the carrying frame and electrically connected to the feeding segments, wherein the splitter is configured for separating a current respectively into the feeding segments by a phase difference of 90 degrees.

In summary, the antenna apparatus of the instant disclosure is provided for a MIMO system. The first and second polarized antenna modules of the antenna device have good isolation, and provide orthogonally polarized and omnidirectional radiation patterns.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 1 through 9, which show a first embodiment of the instant invention. References are hereunder made to the detailed descriptions and appended drawings in connection with the instant invention. However, the appended drawings are merely shown for exemplary purposes, rather than being used to restrict the scope of the instant invention.

Figure 1:
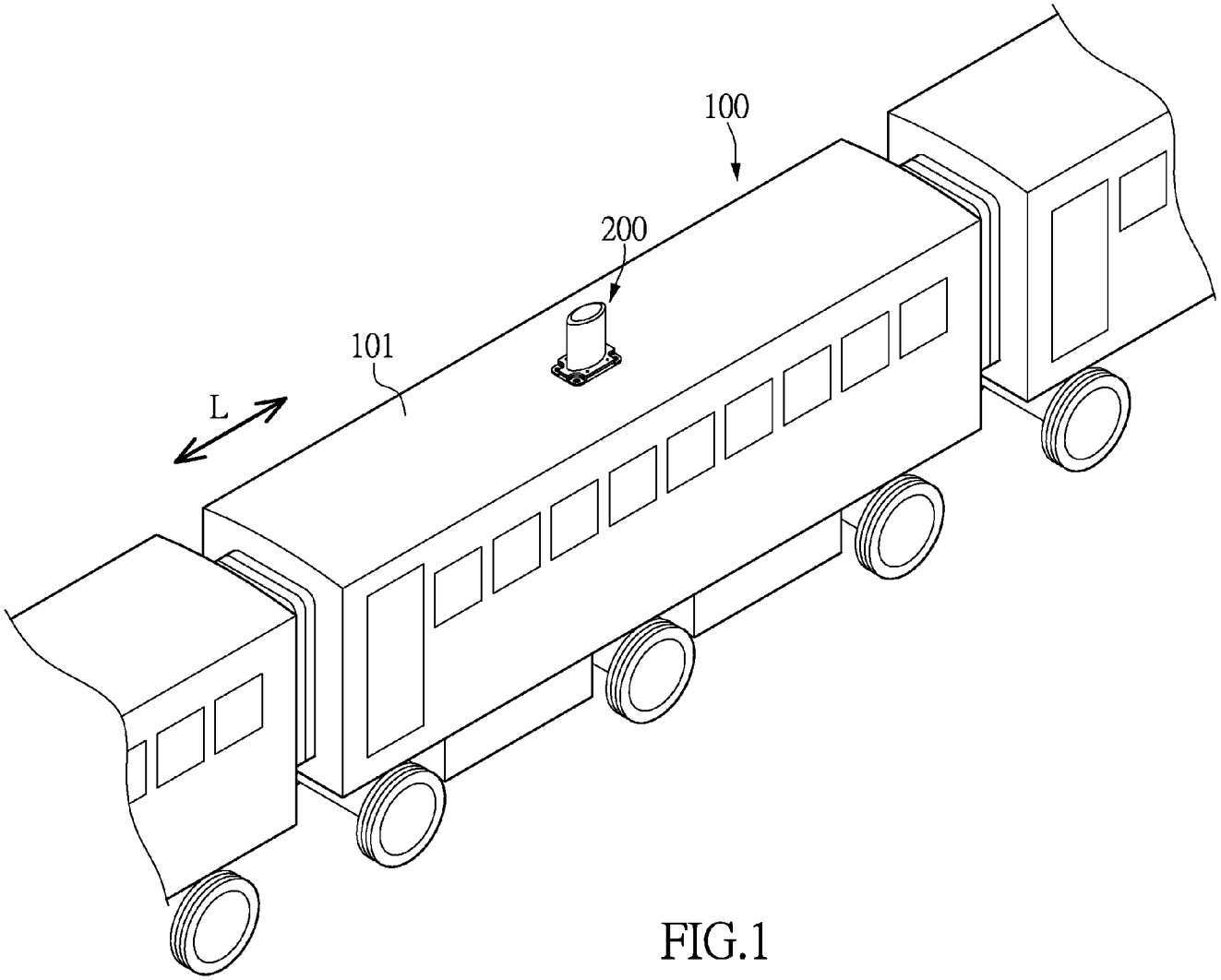
FIG. 1 is a perspective view showing an antenna apparatus of one embodiment of the instant disclosure.

As shown in FIG. 1, the instant embodiment providing an antenna apparatus includes a transportation device 100 and an antenna device 200 mounted on the transportation device 100. The transportation device 100 in the instant embodiment is a cabin 101 for example, and the transportation device 100 (i.e., the cabin 101) has an elongated shape and defines a longitudinal direction L. The speed direction of the cabin 101 is approximately parallel to the longitudinal direction L, but in practical use, the speed direction of the transportation device 100 is changeable according to the topography and the route.

Figure 2:
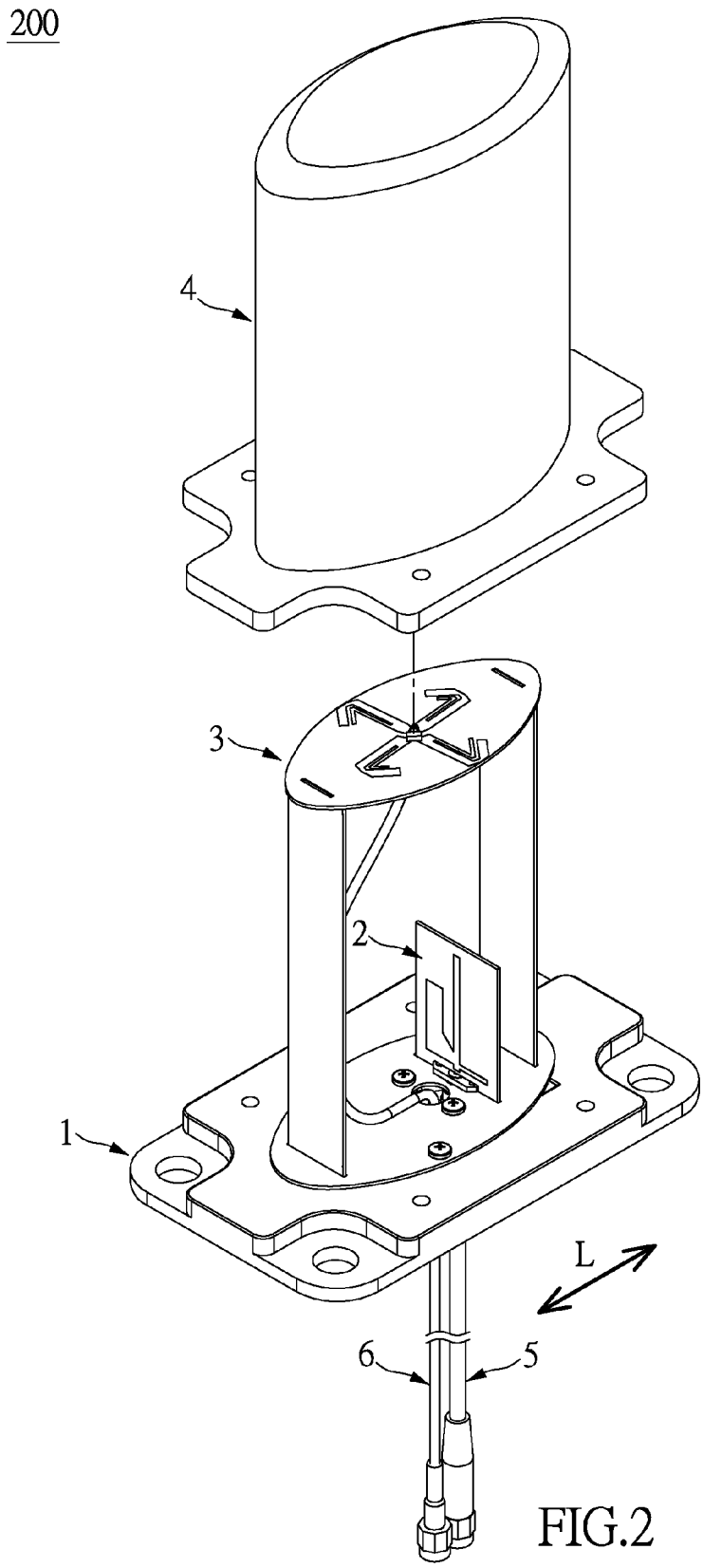
FIG. 2 is a perspective view showing the antenna device as shown in FIG. 1.

Moreover, the antenna device 200 in the instant embodiment is applied to a MIMO system, and the operating frequency range of the antenna device 200 has a dual-band range of about 1700 MHz-1900 MHz and 2500 MHz-2700 MHz. The antenna device 200 in the instant embodiment is applied to long term evolution (LTE) of fourth generation of mobile phone mobile communications standards (4G), but the antenna device 200 is not limited thereto. That is to say, the antenna device 200 can be applied to another kind of 4G (e.g., WiMAX), 2G, or 3G As shown in FIG. 2, the antenna device 200 includes a retaining seat 1, a first polarized antenna module 2, a second polarized antenna module 3, an antenna cover 4, a first cable 5, and a second cable 6. The first and second polarized antenna modules 2, 3 are mounted on the retaining seat 1. The antenna cover 4 is mounted on the retaining seat 1 to cover the first and second polarized antenna modules 2, 3. The first cable 5 is electrically connected to the first polarized antenna module 2, and the second cable 6 is electrically connected to the second polarized antenna module 3.

Figure 3:
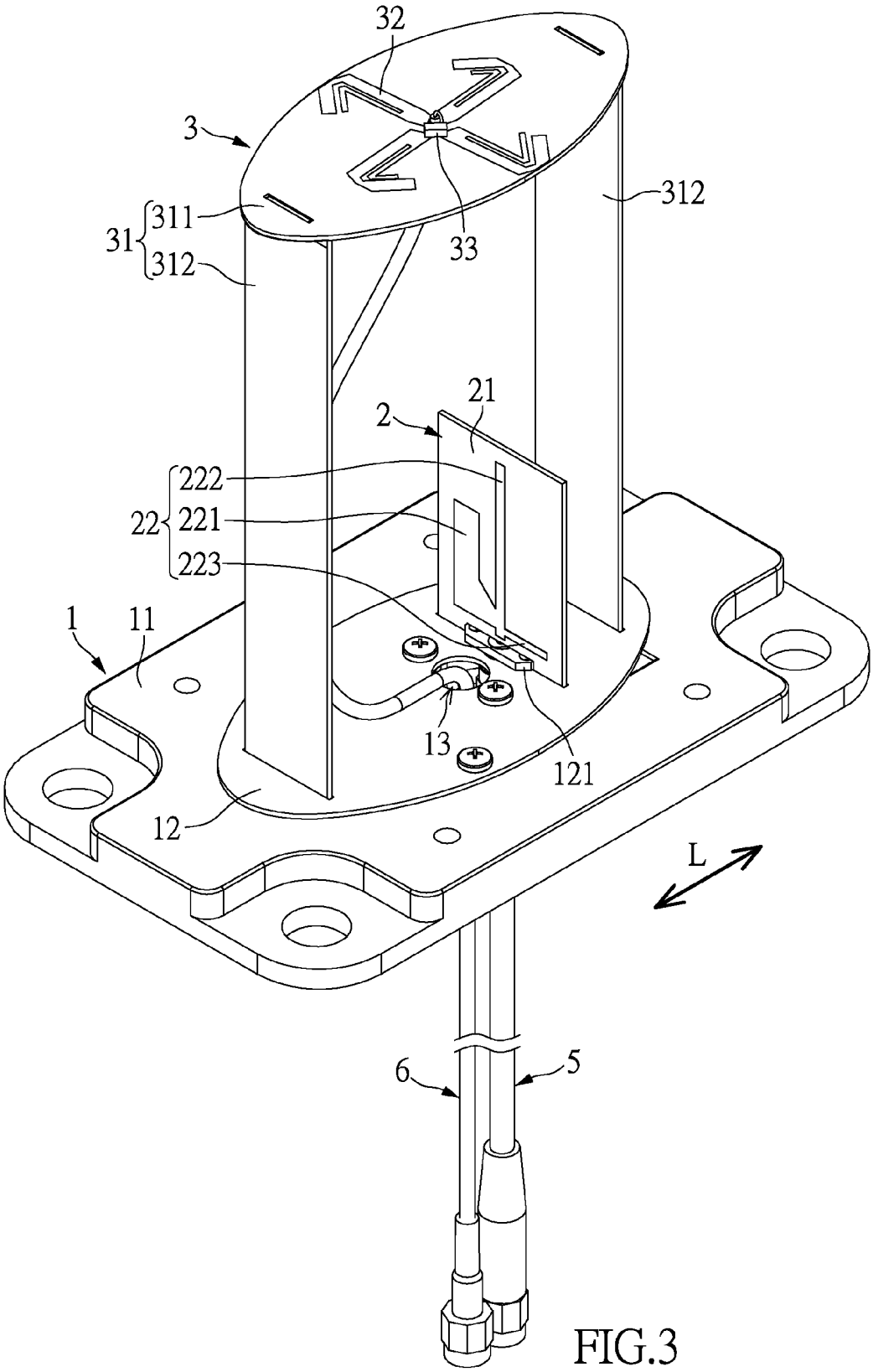
FIG. 3 is a perspective view showing the antenna device as shown in FIG. 2 omitting the antenna cover.
Figure 4:
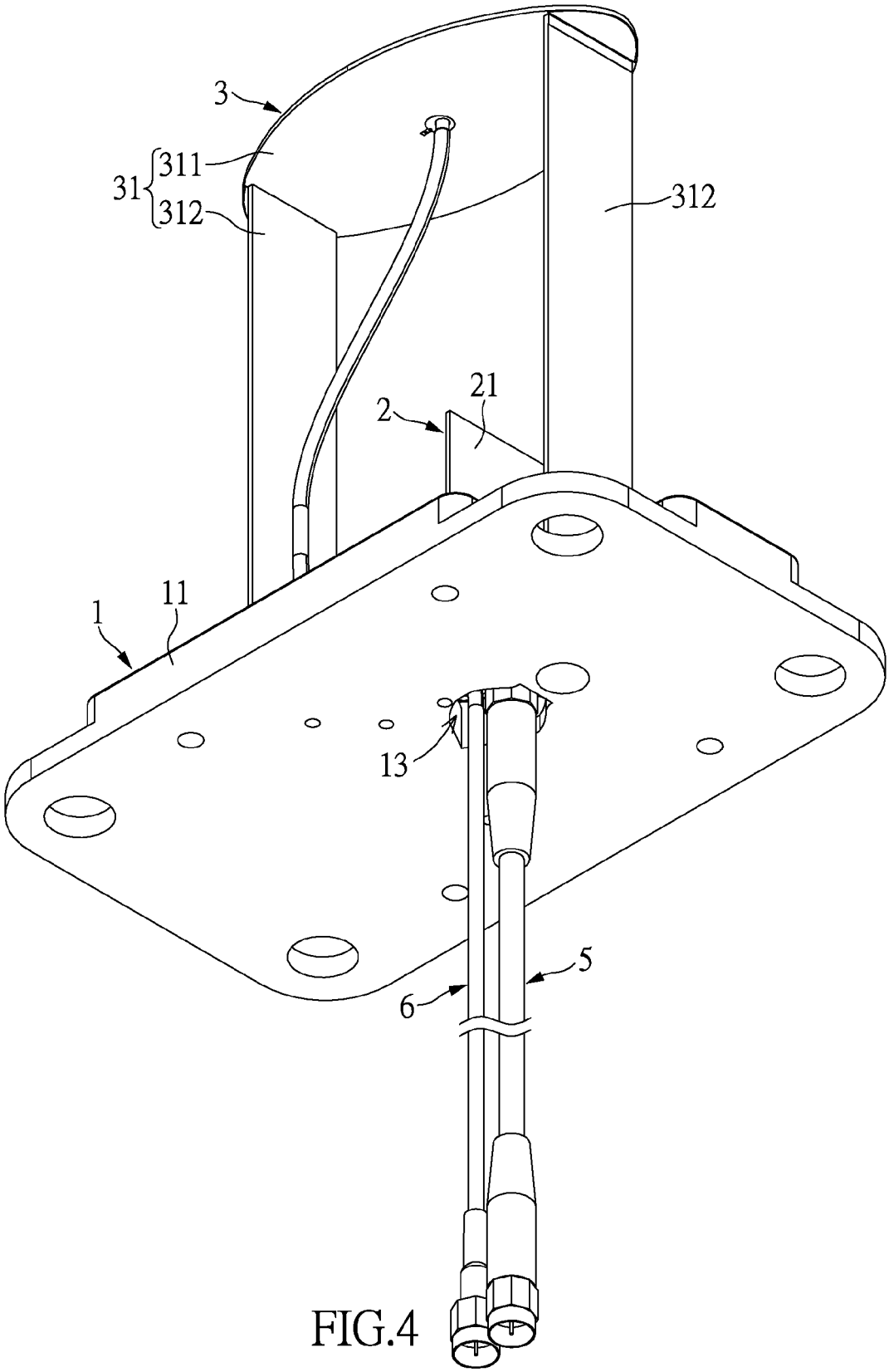
FIG. 4 is a perspective view showing FIG. 3 from another viewing angle.
Figure 5:
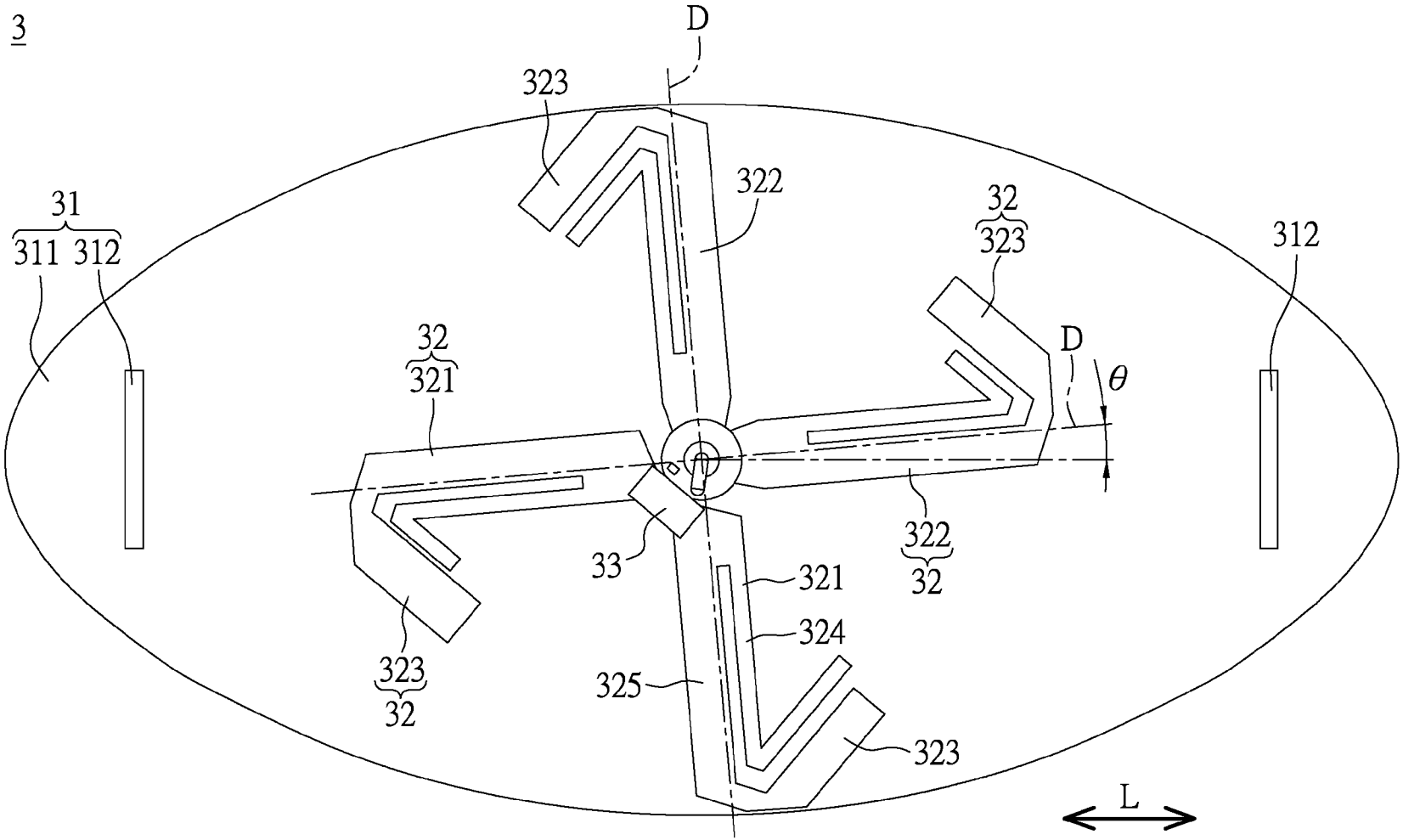
FIG. 5 is a planar view of the second polarized antenna module.

Please refer to FIGS. 3 through 5. The retaining seat 1 has a metal plate 11 mounted on the transportation device 100 and a connecting plate 12 disposed on the metal plate 11. The retaining seat 1 has a thru-hole 13 penetrating the metal plate 11 and the connecting plate 12. Part of the thru-hole 13 formed on the metal plate 11 is larger than part of the thru-hole 13 formed on the connecting plate 12.

Specifically, the metal plate 11 is a substantially rectangular plate. The metal plate 11 is fixed on (e.g., screwed on) the top surface of the transportation device 100, and the longitudinal axis of the metal plate 11 is approximately parallel to the longitudinal direction L of the transportation device 100. The connecting plate 12 has an elliptical shape. The connecting plate 12 is fixed on (e.g., screwed on) the metal plate 11, the contour of the connecting plate 12 is arranged inside the contour of the metal plate 11, and the major axis of the connecting plate 12 is approximately parallel to the longitudinal axis of the metal plate 11. The connecting plate 12 of the instant embodiment includes a socket 121 having electrically conductive function, and the socket 121 is arranged in the part of the thru-hole 13 formed on the connecting plate 12, but is not limited thereto.

The first polarized antenna module 2 has a first board 21 and a dual-band monopole antenna 22 arranged in a first plane. The first board 21 is perpendicularly disposed on the connecting plate 12 of the retaining seat 1, and the first board 21 is perpendicular to the longitudinal direction L of the transportation device 100. The dual-band monopole antenna 22 is formed on an outer surface of the first board 21 and is electrically connected to the socket 121 of the connecting plate 12. In other words, the first plane is approximately perpendicular to the longitudinal direction L of the transportation device 100 (i.e., the cabin 101).

Specifically, the dual-band monopole antenna 22 has a high-frequency segment 221, a low-frequency segment 222, and an impedance matching segment 223. The low-frequency segment 222 has a straight shape and is perpendicular to the connecting plate 12. The high-frequency segment 221 has an L shape, and one end of the high-frequency segment 221 is connected to the low-frequency segment 222. The high-frequency segment 221 and the impedance matching segment 223 are respectively arranged at two opposite sides of the low-frequency segment 222 (i.e., the left side and the right side of the low-frequency segment 222 as shown in FIG. 3). Moreover, the feeding point and the grounding point (not labeled) of the dual-band monopole antenna 22 are connected to the socket 121 of the connecting plate 12.

Figure 6:
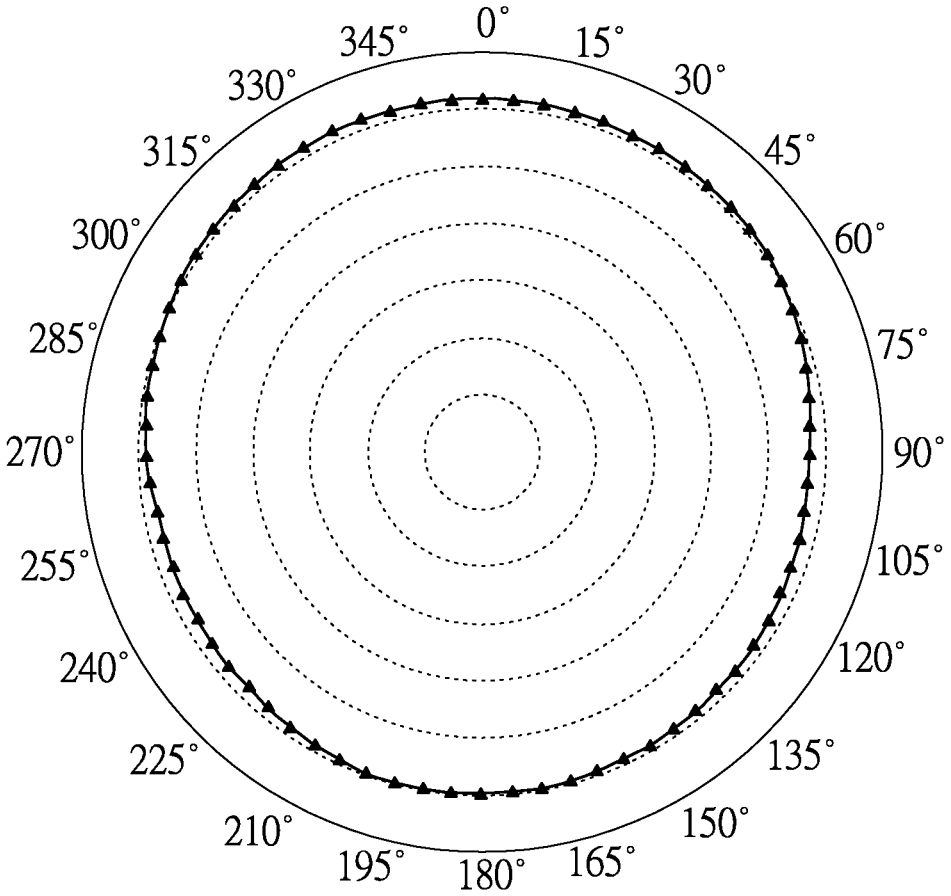
FIG. 6 is a radiation pattern diagram showing the dual-band monopole antenna vertically polarized in a horizontal direction at low frequency (i.e., 1800 MHz)
Figure 7:
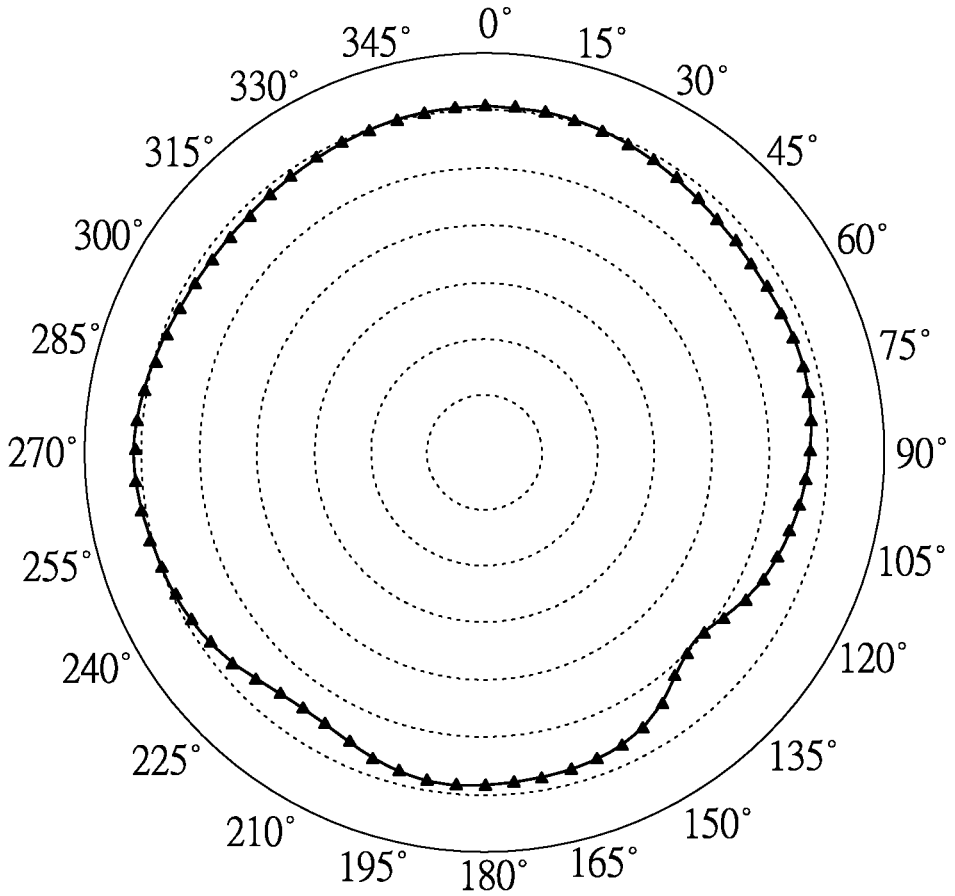
FIG. 7 is a radiation pattern diagram showing the dual-band monopole antenna vertically polarized in a horizontal direction at high frequency (i.e., 2600 MHz)

Thus, the dual-band monopole antenna 22 is provided with an omnidirectional radiation pattern in the first plane (such as the outer surface of the first board 21) by the structural design thereof. Furthermore, when the transportation device 100 moves, the antenna device 200 as shown in FIG. 1 has a radiation pattern diagram as shown in FIG. 6, which shows the dual-band monopole antenna 22 vertically polarized in a horizontal direction at low frequency (i.e., 1800 MHz), and a radiation pattern diagram as shown in FIG. 7, which shows the dual-band monopole antenna 22 vertically polarized in a horizontal direction at high frequency (i.e., 2600 MHz).

The second polarized antenna module 3 has a carrying frame 31, two dual-band dipole antennas 32, and a splitter 33. The carrying frame 31 has an elliptical second board 311 and two supporting boards 312 respectively arranged at two opposite sides of the first board 21. The bottom ends of the supporting boards 312 are respectively fixed on two opposite portions of the major axis of the connecting plate 12, and the top ends of the supporting boards 312 are respectively fixed on two opposite portions of the major axis of the second board 311, thereby maintaining the second board 311 parallel to the connecting plate 12 and arranging the first board 21 between the second board 311 and the connecting plate 12.

Specifically, the second board 311 is arranged apart from the first board 21 for increasing the isolation there-between. Moreover, the second board 311 and the first board 21 are approximately perpendicular to each other. The thru-hole 13 of the retaining seat 1 is approximately arranged between the first board 21 and one of the supporting boards 312 away from the first board 21 (i.e., the left supporting board 312 as shown in FIG. 3). Additionally, the instant embodiment discloses two supporting boards 312 for example, but the carrying frame 31 may only have one supporting board 311 if the supporting board 311 is strong enough to firmly support the second board 311.

The dual-band dipole antennas 32 are arranged in a second plane approximately perpendicular to the first plane. Specifically, the dual-band dipole antennas 32 are formed on the top surface of the second board 311 of the carrying frame 31. A polarized direction of the dual-band dipole antennas 32 (i.e., the horizontally polarized direction) is approximately perpendicular to a polarized direction of the dual-band monopole antenna 22 (i.e., the vertically polarized direction).

The structural designs of the dual-band dipole antennas 32 are identical, so the following description discloses the structural design of one of the dual-band dipole antennas 32. The dual-band dipole antenna 32 has a feeding segment 321, a grounding segment 322, and two extending segments 323. The dual-band dipole antenna 32 defines a longitudinal axis D. The grounding segment 322 is arranged apart from the feeding segment 321, and the feeding segment 321 and the grounding segment 322 of each dual-band dipole antenna 32 are arranged along the corresponding longitudinal axis D. In other words, the feeding segment 321 and the grounding segment 322 of each dual-band dipole antenna 32 are arranged in an elongated construction. Moreover, at each dual-band dipole antenna 32, the extending segments 323 are respectively extended from one end of the feeding segment 321 and one end of the grounding segment 322 away from each other. An angle between each feeding segment 321 and the corresponding extending segment 323 is substantially identical to an angle between each grounding segment 322 and the corresponding extending segment 323, and the angle between each feeding segment 321 and the corresponding extending segment 323 is smaller than 60 degrees.

Furthermore, each one of the feeding segment 321 and the grounding segment 322 has a high-frequency portion 324 and a low-frequency portion 325 adjacent to and parallel to the high-frequency portion 324. The width and the length of the high-frequency portion 324 are respectively smaller than the width and the length of the corresponding low-frequency portion 325. The extending segment 323 is extended from the high-frequency portion 324 and the corresponding low-frequency portion 325.

The following description discloses the structural design of the two dual-band dipole antennas 32. The longitudinal axes D of the dual-band dipole antennas 32 are substantially perpendicular to each other. One of the ends of the feeding segments 321 adjacent to each other respectively have two feeding points (not labeled), one of the ends of the feeding segments 322 adjacent to each other respectively have two grounding points (not labeled). Specifically, the dual-band dipole antennas 32 are in four-fold rotational symmetry arrangement, that is to say, when rotating the dual-band dipole antennas 32 about 360 degrees, the rotating dual-band dipole antennas 32 overlap the original position of the dual-band dipole antennas 32 four times.

Moreover, at the second plane (i.e., the top surface of the second board 311), a smallest angle θ between the longitudinal direction L of the transportation device 100 (i.e., the cabin 101) and one of the longitudinal axes D of the dual-band dipole antennas 32 is substantially 0-10 degrees. Therefore, the dual-band dipole antennas 32 have stronger radiation strength with respect to two opposite sides of the longitudinal direction L of the transportation device 100 (i.e., the front and the rear sides of the movement of the transportation device 100).

The smallest angle θ can be regarded as an angle between the major axis of the second board 311, which is parallel to the longitudinal direction L, and one of the longitudinal axes D of the dual-band dipole antennas 32. Moreover, the smallest angle θ in the instant embodiment is 5 degrees for example, but is not limited thereto. For example, the smallest angle θ can be 10 degrees if abandoning some effect.

Figure 8:
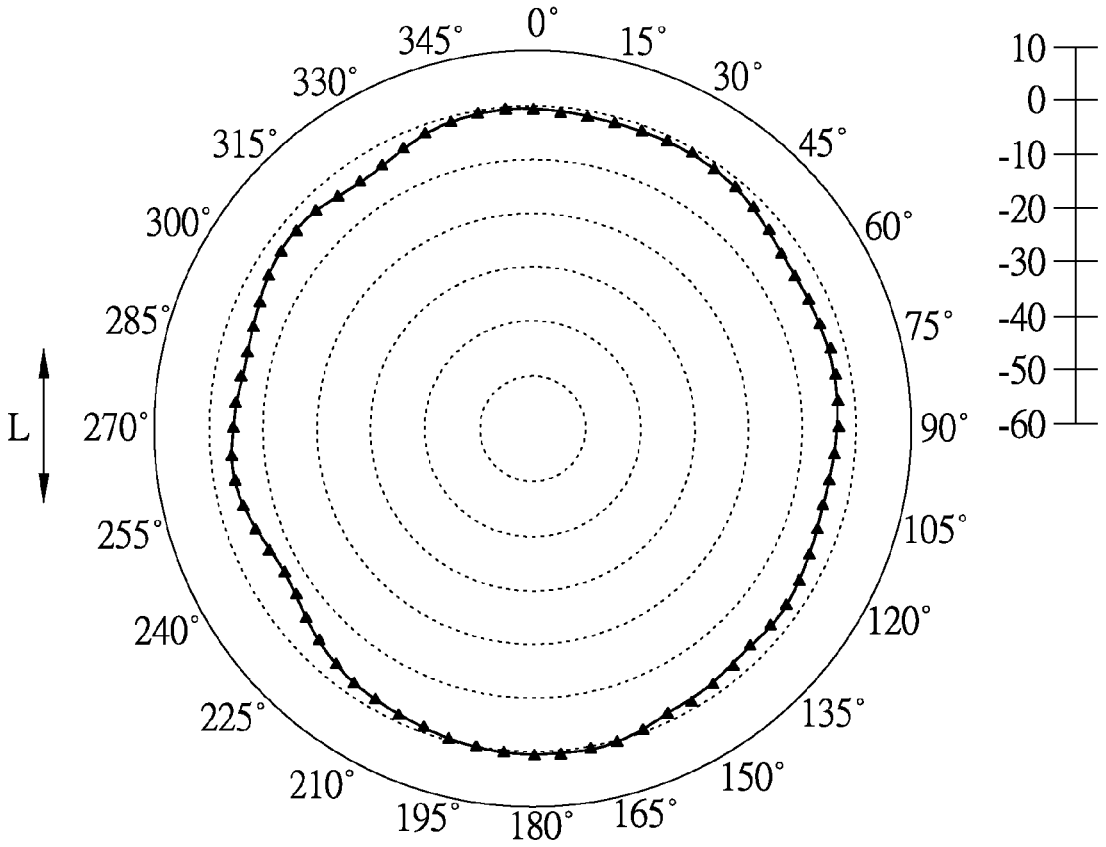
FIG. 8 is a radiation pattern diagram showing the dual-band dipole antenna horizontally polarized in a horizontal direction at low frequency (i.e., 1800 MHz)
Figure 9:
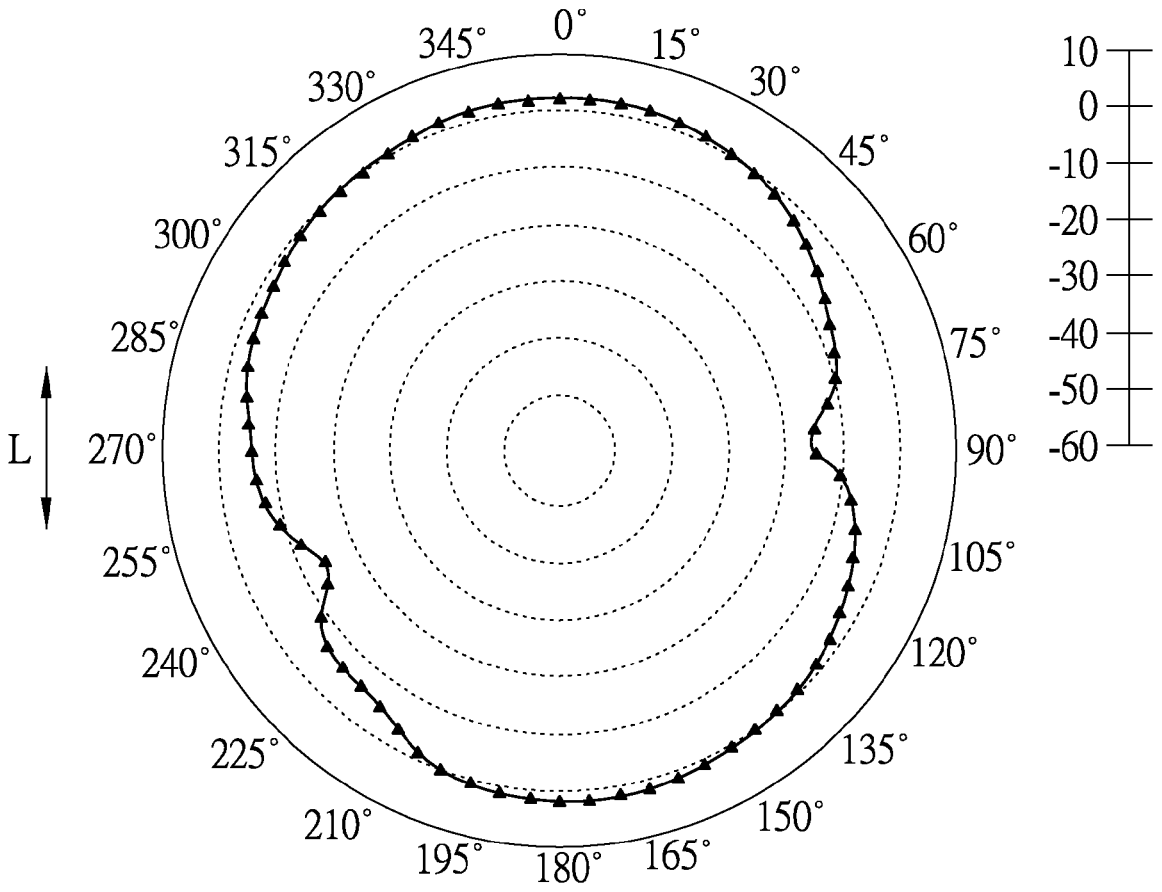
FIG. 9 is a radiation pattern diagram showing the dual-band dipole antenna horizontally polarized in a horizontal direction at high frequency (i.e., 2600 MHz)

The splitter 33 is mounted on the top surface of the second board 311 of the carrying frame 31, and the splitter 33 is structurally and electrically connected to the feeding point of each feeding segment 321. In the structural design of the antenna device 200 as shown in FIG. 2, the splitter 33 is configured for separating a current respectively into the feeding segments 321 by a phase difference of 90 degrees. Thus, at the second plane (i.e., the top surface of the second board 311), the radiation patterns of the dual-band dipole antennas 32 can be overlapped with each other to form a circular polarization for generating an omnidirectional radiation pattern (as shown in FIGS. 8 and 9). Specifically, when the transportation device 100 moves, the antenna device 200 as shown in FIG. 1 has a radiation pattern diagram as shown in FIG. 8, which shows the dual-band dipole antennas 32 horizontally polarized in a horizontal direction at low frequency (i.e., 1800 MHz), and a radiation pattern diagram as shown in FIG. 9, which shows the dual-band dipole antennas 32 horizontally polarized in a horizontal direction at high frequency (i.e., 2600 MHz).

The first cable 5 includes a signal portion (not labeled) and a grounding portion (not labeled). The first cable 5 passes through the metal plate 11 of the retaining seat 1 to insert into the socket 121 of the connecting plate 12, so that the signal portion and the grounding portion of the first cable 5 are respectively electrically connected to the feeding point and the grounding point of the dual-band monopole antenna 22 via the socket 121 of the connecting plate 12.

The second cable 6 includes a signal portion (not labeled) and a grounding portion (not labeled). The second cable 6 passes through the thru-hole 13 of the retaining seat 1, and the signal portion and the grounding portion of the second cable 6 are respectively electrically connected to the splitter 33 and the grounding points of the grounding segments 322 of the dual-band dipole antennas 32. Moreover, a portion of the second cable 6 arranged between the second board 311 and the connecting plate 12 is at least partially fixed on the connecting plate 12 and the supporting board 312 away from the first board 21 (i.e., the left supporting board 312 as shown in FIG. 3) for arranging the second cable 6 away from the dual-band monopole antenna 22, thereby maintaining the isolation between the dual-band monopole antenna 22 and the dual-band dipole antennas 32 to lower than −30 dB.

Figure 10:
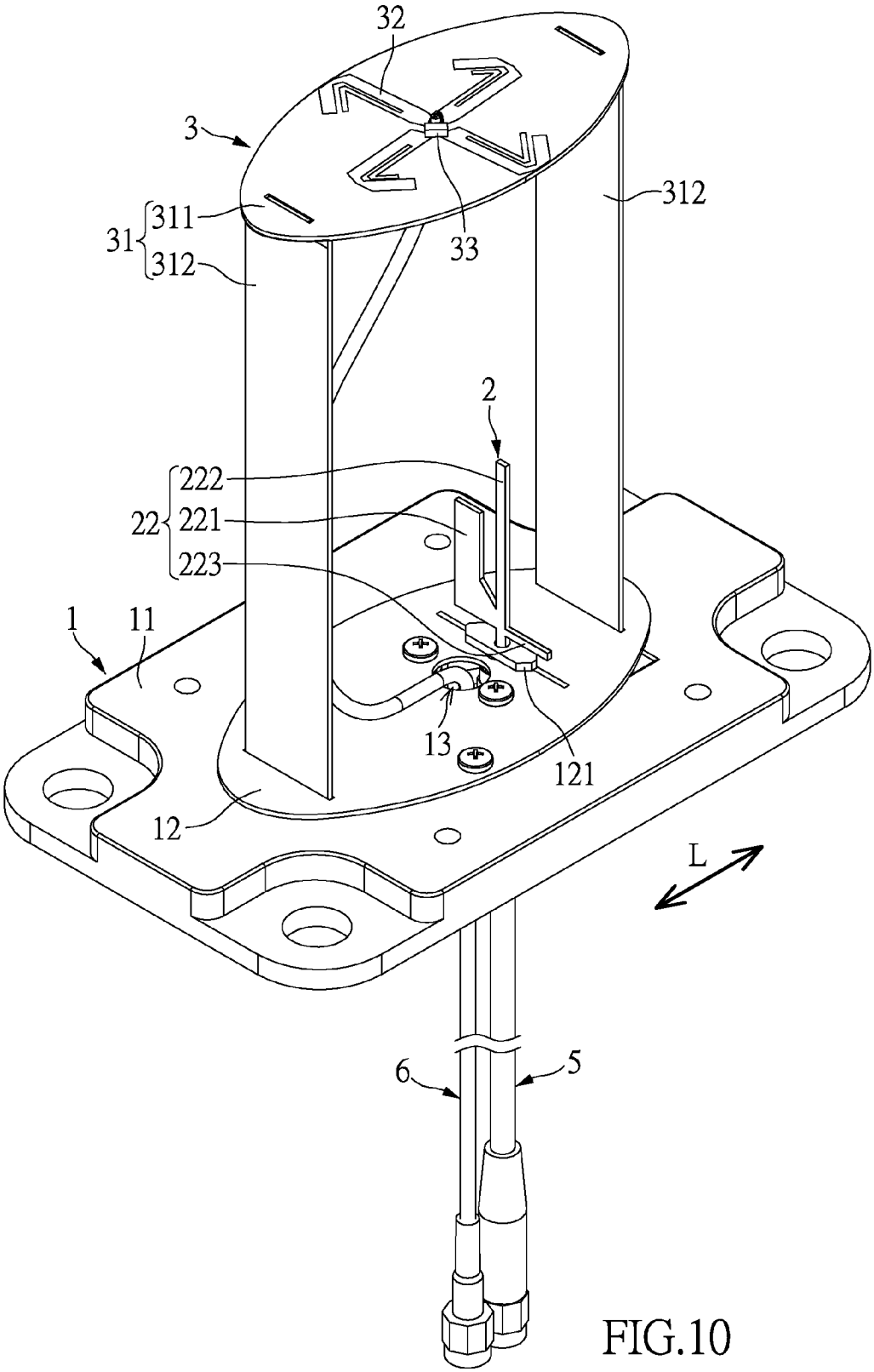
FIG. 10 is a perspective view showing the antenna device of another embodiment omitting the antenna cover.

Please refer to FIG. 10, which shows a second embodiment of the instant disclosure. The instant embodiment is similar to the first embodiment, and the identical features are not disclosed again. The different features between the two embodiments are disclosed as follows. The first polarized antenna module 2 of the instant embodiment is provided without the first board 21 of the first embodiment, that is to say, the dual-band monopole antenna 22 of the instant embodiment does not need to be formed on the first board 21. Specifically, the dual-band monopole antenna 22 of the instant embodiment is a metal sheet and is perpendicularly disposed on the socket 121 of the connecting plate 12 of the retaining seat 1.

In summary, the antenna apparatus of the instant disclosure is provided for a MIMO system. The first and second polarized antenna modules of the antenna device have good isolation, and provide omnidirectional radiation patterns orthogonally polarized. That is to say, the antenna device not only conforms to the request of a MIMO system, but also has omnidirectional and orthogonally polarized radiation patterns.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. An antenna apparatus, comprising:

a transportation device having an elongated shape and defining a longitudinal direction;

an antenna device, comprising:

a retaining seat mounted on the transportation device;

a first polarized antenna module disposed on the retaining seat, wherein the first polarized antenna module has a dual-band monopole antenna arranged in a first plane approximately perpendicular to the longitudinal direction; and a second polarized antenna module, comprising:

a carrying frame disposed on the retaining seat;

two dual-band dipole antennas formed on the carrying frame and arranged in a second plane, wherein each dual-band dipole antenna defines a longitudinal axis, each dual-band dipole antenna has a feeding segment and a grounding segment arranged apart from the feeding segment, and the feeding segment and the grounding segment of each dual-band dipole antenna are arranged along the corresponding longitudinal axis, wherein the longitudinal axes of the dual-band dipole antennas are substantially perpendicular to each other, the second plane is approximately perpendicular to the first plane, a polarized direction of the dual-band dipole antennas is approximately perpendicular to a polarized direction of the dual-band monopole antenna; and a splitter mounted on the carrying frame and electrically connected to the feeding segments, wherein the splitter is configured for separating a current respectively into the feeding segments by a phase difference of 90 degrees.

2. The antenna apparatus as claimed in claim 1, wherein one of the ends of the feeding segments adjacent to each other respectively have two feeding points, one of the ends of the feeding segments adjacent to each other respectively have two grounding points, the splitter is electrically connected to the feeding point of each feeding segment.

3. The antenna apparatus as claimed in claim 1, wherein each dual-band dipole antenna has two extending segments; at each dual-band dipole antenna, the extending segments are respectively extended from one end of the feeding segment and one end of the grounding segment away from each other.

4. The antenna apparatus as claimed in claim 3, wherein an angle between each feeding segment and the corresponding extending segment or an angle between each grounding segment and the corresponding extending segment is smaller than 60 degrees.

5. The antenna apparatus as claimed in claim 1, wherein the two dual-band dipole antennas are in four-fold rotational symmetry arrangement.

6. The antenna apparatus as claimed in claim 1, wherein the retaining seat has a metal plate mounted on the transportation device and a connecting plate disposed on the metal plate, the first polarized antenna module has a first board perpendicularly disposed on the connecting plate, the dual-band monopole antenna is formed on the first board and is electrically connected to the connecting plate.

7. The antenna apparatus as claimed in claim 6, wherein the carrying frame has a second board and at least one supporting board, the dual-band dipole antennas are formed on the second board, the supporting board connects to the connecting plate and the second board for maintaining the second board parallel to the connecting plate and arranging the first board between the second board and the connecting plate.

8. The antenna apparatus as claimed in claim 7, wherein retaining seat has a thru-hole penetrating the metal plate and the connecting plate, the thru-hole is approximately arranged between the first board and the supporting board; the antenna device comprises a first cable and a second cable, the first cable is connected to the connecting plate for electrically connecting to the dual-band monopole antenna via the connecting plate, the second cable passes through the thru-hole and is electrically connected to the splitter and the grounding segment of each dual-band dipole antenna, and a portion of the second cable arranged between the second board and the connecting plate is at least partially fixed on the supporting board and the connecting plate for arranging away from the dual-band monopole antenna.

9. The antenna apparatus as claimed in claim 1, wherein at the second plane, an angle between the longitudinal direction of the transportation device and one of the longitudinal axes of the dual-band dipole antennas is substantially 0-10 degrees.

10. An antenna device, comprising:

a retaining seat;

a first polarized antenna module disposed on the retaining seat, wherein the first polarized antenna module has a dual-band monopole antenna arranged in a first plane; and a second polarized antenna module, comprising:

a carrying frame disposed on the retaining seat;

two dual-band dipole antennas formed on the carrying frame in a second plane, wherein each dual-band dipole antenna defines a longitudinal axis, each dual-band dipole antenna has a feeding segment and a grounding segment arranged apart from the feeding segment, and the feeding segment and the grounding segment of each dual-band dipole antenna are arranged along the corresponding longitudinal axis, wherein the longitudinal axes of the dual-band dipole antennas are substantially perpendicular to each other, the second plane is approximately perpendicular to the first plane, a polarized direction of the dual-band dipole antennas is approximately perpendicular to a polarized direction of the dual-band monopole antenna; and a splitter mounted on the carrying frame and electrically connected to the feeding segments, wherein the splitter is configured for separating a current respectively into the feeding segments by a phase difference of 90 degrees.

* * * * *